US005364161A

United States Patent [19]

Liu

[11] Patent Number: 5,364,161

[45] Date of Patent: Nov. 15, 1994

[54] INFLATABLE ROCKING CHAIR

[76] Inventor: Chang-Hsiung Liu, 2 Fl. No. 6-2 Lane 269 Nan Chiung Rd. Sec. 3, Taipei, Taiwan, Prov. of China

[21] Appl. No.: 60,642

[22] Filed: May 13, 1993

[51] Int. Cl.[5] ..... A63G 19/00

[52] U.S. Cl. ..... 297/195.11; 297/181; 297/272; 297/452.41; 297/440.24; 472/134; 472/102; D6/345

[58] Field of Search ..... 297/258, 272, 195.11, 297/181, 440.1, 452.41, 199, 452.2, 440.24; 472/95, 134, 102, 135; D21/68, 73, 344, 345, 348

[56] References Cited

U.S. PATENT DOCUMENTS

| | | | |
|---|---|---|---|
| D. 224,601 | 8/1972 | Cone | 472/135 |
| 264,917 | 9/1882 | Andrews | 297/272 |
| 619,244 | 2/1899 | Young | 297/199 |
| 4,093,208 | 6/1978 | Tomalinas | 297/272 |
| 4,129,296 | 12/1978 | Meyer | 297/272 |
| 5,048,892 | 9/1991 | Ledbetter | 297/452.41 |
| 5,121,962 | 6/1992 | Weber | 297/199 |

FOREIGN PATENT DOCUMENTS

| | | | |
|---|---|---|---|
| 1268202 | 6/1961 | France | 297/272 |
| 1315408 | 12/1962 | France | 472/102 |
| 1364492 | 5/1964 | France | 472/102 |
| 2548547 | 1/1985 | France | 472/134 |
| 2014314 | 10/1971 | Germany | 297/272 |

*Primary Examiner*—Kenneth J. Dorner
*Assistant Examiner*—David E. Allred
*Attorney, Agent, or Firm*—Morton J. Rosenberg; David I. Klein

[57] ABSTRACT

An inflatable rocking chair comprising a seat and a frame. The seat is inflatable having a holding portion and a sitting portion. The frame is formed from a plurality of tubes having two connecting tubes which forms the horizontal tubes of the chair. Two arch-shaped tubes contact the ground to provide a rocking function of the chair. Two U-shaped tubes are used to connect the connecting tubes with the arch-shaped tubes so as to provide the frame and the inflatable seat as one unit. The frame of the inflatable chair is detachable.

1 Claim, 3 Drawing Sheets

INFLATABLE ROCKING CHAIR

BACKGROUND OF THE INVENTION

The present invention relates to a easy detachable and combinative inflatable rocking chair, in particular to a new chair frame and chair which is inflatable and can be detached to several parts. The rocking chair can be easily combined or detached for storage.

Conventionally, most of the rocking chairs are made into shapes of animals for the playing of children, or are made for the leisure of the home. However, the bottom of the chair is made into arch-shaped, the rocking chair occupies a large space which is unsuitable for houses having limited leisure space.

Another drawback of the conventional rocking chair is that these rocking chairs cannot be detached. As a result, these rocking chairs are not portable for use in out-door. It is also troublesome for the manufacturers to pack and transport the chairs. As a result, in marketing the product, extra cost is involved and the product is easily damaged.

If the parts of the chair are designed for easily combination or detachable from each other, the packing for the chair will occupy little space. As a result, the above drawbacks will be overcome. Besides, it is portable and can be used for out-door activities. Thus, the rocking chair in accordance with the present invention is practical and can be economically made.

SUMMARY OF THE INVENTION

It is an object of the present invention to provide an inflatable rocking chair, wherein the chair body can be inflated with air. The chair body includes a closed internal chamber, a holding portion, and a seating section or sitting pad portion and the frame is formed from a plurality of tubes. Two horizontal tubes are used to mount horizontally across the chair body in a pair of longitudinally spaced and transversely extending body through openings passing therethrough two arch-shaped tubes are mounted substantially parallel at the bottom of the chair body to provide rocking motion. Two inverted U-shaped tubes are connected to the arch-shaped tube to form as a unit together with the chair body.

It is another object of the present invention to provide an inflatable rocking chair, wherein the shape of the chair body can be designed with various types of animal shapes, or the shapes of furniture.

It is yet another object of the present invention to provide an inflatable rocking chair, wherein the parts are simple in construction which facilitate detaching from each other and combining with each other.

DETAILED DESCRIPTION OF THE PRESENT INVENTION

Figure 1:
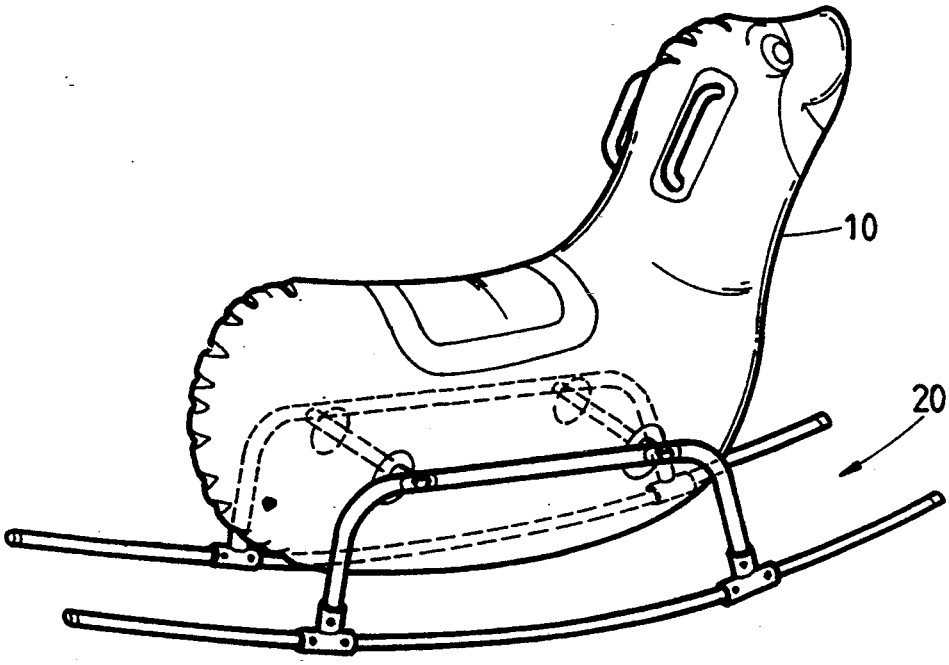
FIG. 1 is the perspective view of the inflatable rocking chair in accordance with the present invention.
Figure 2A:
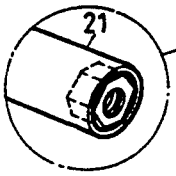
FIG. 2 is an exploded view of parts of the rocking chair in accordance with the inflatable rocking chair shown in FIG. 1.
Figure 2:
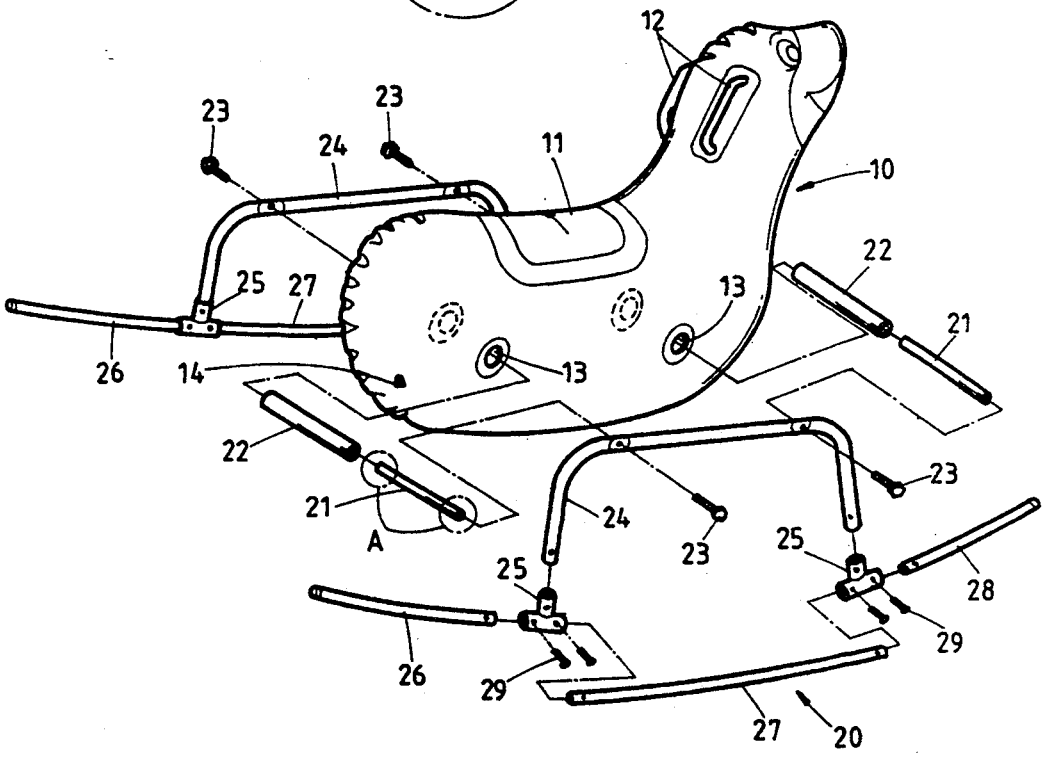
Figure 3:
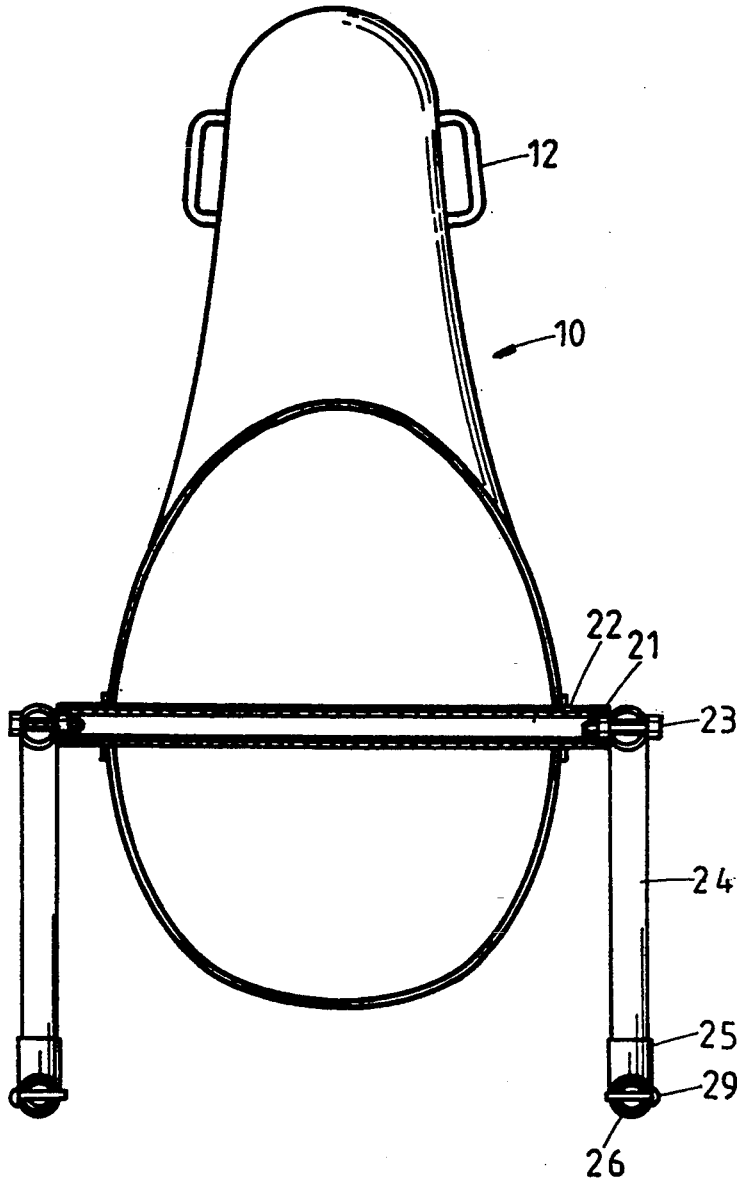
FIG. 3 is a sectional view of the rocking chair in accordance with the present invention.

Referring to FIG. 1, there is shown a combinative and detachable rocking chair 10 comprising and inflatable chair body and a frame body 20.

The chair body 10 is inflatable comprising a sitting pad 11 and a handle member or holding portion 12. At the lower lateral edge of the seating section or sitting pad 11, hole 13 and a valve 14 for air releasing and filling are provided.

The frame body 20 is formed from a plurality of tubes, which comprises two connecting tubes 21, two PVC tubular members 22, two U-shaped tubes 24, four T-shaped joint tube 25 and two sets of six arch-shaped tubes 26, 27, and 28.

The external of the connecting tube 21 are mounted by the PVC members 22 and can be mounted horizontally within the body through openings 13 provided to the chair body 10. The arch-shaped tubes 26, 27, 28 are respectively mounted by the T-shaped joint 25 and screws 29 to form the arch-shaped structure of the chair body 10 for the rocking of the chair. The two U-shaped tubes 24 are provided at the two lateral edge of the chair body 10. The two leg portions of the U-shaped tubes 24 are connected by the T-shaped joint tube 25 and the base portions are connected to the connecting tube 21 by screw 23 to form the frame body 20 which connected with the chair body 10 as one unit.

After the rocking chair is formed, the user can sit on sitting pad 11 and the hands of the user are placed on the handle member or holding portion 12 for the rocking movement. When the parts of the rocking chair are to be detached, the screws 23, 29 are loosened, the valve 14 is operated to release the inflated air and the chair body 10 is reduce to a small volume. Thus the rocking chair will not occupy a large space.

Different animal shapes of chair body 10 can be used on the strductrue of the rocking chair, or the structrue can be made to adapt users having a large body. According to the present invention, the structrue can easily be combined and detached for storage.

The nature of the present invention has sufficiently be described, if needs only be added that it is possible to introduce changes of form, material, and arrangement to the invention as a whole and its component parts without departing from the framework of the invention, in as much as such alterations do not invalidate its basis.

I claim:

1. An inflatable rocking chair comprising:

(a) an inflatable chair body defining a closed internal chamber having a seating section and at least one handle member, said inflatable body further having a pair of longitudinally spaced and transversely extending body through openings passing therethrough;

(b) a valve member secured to said chair body for insert of an inflating medium into said internal chamber;

(c) a frame body including a pair of inverted U-shaped tubular members mounted on opposing transverse sides of said inflatable chair body, a pair of connecting tubes enveloped by a pair of respective tubular members, each of said connecting tubes extending through a respective one of said body through openings and threadedly connected on opposing ends thereof to a base portion of each of said inverted U-shaped tubular members, and a plurality of arch-shaped tubular frame members secured to a leg portion of each of said inverted U-shaped tubular members by a respective plurality of T-shaped joint members.

* * * * *